US009206026B2

(12) United States Patent
Aulton et al.

(10) Patent No.: US 9,206,026 B2
(45) Date of Patent: Dec. 8, 2015

(54) LONGITUDINAL STABILITY MONITORING SYSTEM

(75) Inventors: Steven Aulton, Loughborough (GB); Muhammad Sannah, Greencastle, PA (US); Ignacy Puszkiewicz, Hagerstown, MD (US)

(73) Assignee: JLG Industries, Inc., Hagerstown, MD (US)

( * ) Notice: Subject to any disclaimer, the term of this patent is extended or adjusted under 35 U.S.C. 154(b) by 0 days.

(21) Appl. No.: 13/884,784

(22) PCT Filed: Nov. 14, 2011

(86) PCT No.: PCT/US2011/060561

§ 371 (c)(1),
(2), (4) Date: May 10, 2013

(87) PCT Pub. No.: WO2012/065157

PCT Pub. Date: May 18, 2012

(65) Prior Publication Data

US 2013/0238202 A1 Sep. 12, 2013

Related U.S. Application Data

(60) Provisional application No. 61/413,113, filed on Nov. 12, 2010.

(51) Int. Cl.
*B66F 17/00* (2006.01)
*B66F 9/20* (2006.01)
(Continued)

(52) U.S. Cl.
CPC ..... *B66F 9/20* (2013.01); *B66F 9/0655* (2013.01); *B66F 9/24* (2013.01); *B66F 17/00* (2013.01)

(58) Field of Classification Search
USPC ..... 701/4, 50; 56/503, 504, 90, 97, 171, 56/212, 213, 214, 292
See application file for complete search history.

(56) References Cited

U.S. PATENT DOCUMENTS 3,877,544 A 4/1975 McCollum
4,042,135 A * 8/1977 Pugh et al. ..... 414/718
(Continued)

FOREIGN PATENT DOCUMENTS

CN 1681731 10/2005
GB 1 361 832 7/1974
(Continued)

OTHER PUBLICATIONS

Japanese Office Action dated May 20, 2014 issued in Japanese Patent Application No. 2013-538968 and English translation, 5 pp.
(Continued)

*Primary Examiner* — John R Olszewski
*Assistant Examiner* — James M McPherson
(74) *Attorney, Agent, or Firm* — Nixon & Vanderhye P.C.

(57) ABSTRACT

A longitudinal stability monitoring system controls a boom lift down speed for a lift vehicle. The lift vehicle includes a vehicle chassis supported on front and rear wheels respectively coupled with a front axle and a rear axle, and a boom pivotally coupled to the lift vehicle. The system monitors a vertical load on the rear axle and manages boom lift down speed based on the vertical load. Additionally, the system may manage the boom lift down speed based on both the vertical load on the rear axle and an anticipated operator demand according to a signal from an operator input device.

11 Claims, 2 Drawing Sheets

(51) Int. Cl.

| | |
|---|---|
| ***B66F 9/065*** | (2006.01) |
| ***B66F 9/24*** | (2006.01) |

(56) References Cited

U.S. PATENT DOCUMENTS

| | | | | |
|---|---|---|---|---|
| 5,058,752 | A | 10/1991 | Wacht et al. | |
| 5,160,055 | A | 11/1992 | Gray | |
| 6,434,437 | B1 * | 8/2002 | Brandt et al. | 700/69 |
| 6,473,679 | B1 * | 10/2002 | Tady et al. | 701/50 |
| 7,370,723 | B2 * | 5/2008 | Bitter et al. | 180/290 |
| 7,717,664 | B2 * | 5/2010 | Bitter et al. | 414/699 |
| 7,756,622 | B2 * | 7/2010 | Gianoglio et al. | 701/50 |
| 7,770,681 | B2 * | 8/2010 | Marathe et al. | 180/197 |
| 7,845,896 | B2 * | 12/2010 | Bitter et al. | 414/699 |
| 8,244,409 | B2 * | 8/2012 | Bergsten | 701/1 |
| 8,437,920 | B2 * | 5/2013 | Hobenshield et al. | 701/50 |
| 8,538,635 | B2 * | 9/2013 | Uematsu et al. | 701/48 |
| 2004/0200644 | A1 * | 10/2004 | Paine et al. | 177/136 |
| 2006/0103336 | A1 * | 5/2006 | Brooks et al. | 318/139 |
| 2008/0063501 | A1 | 3/2008 | Bitter et al. | |
| 2009/0157266 | A1 * | 6/2009 | Krimbacher | 701/50 |
| 2009/0319133 | A1 * | 12/2009 | Ekvall et al. | 701/50 |
| 2010/0322753 | A1 * | 12/2010 | Brooks et al. | 414/718 |
| 2012/0039696 | A1 | 2/2012 | Brooks et al. | |

FOREIGN PATENT DOCUMENTS

| | | | |
|---|---|---|---|
| GB | 1 590 709 | | 6/1981 |
| GB | 2 390 595 | | 1/2004 |
| JP | 52-124655 | | 10/1977 |
| JP | 2001-206695 | | 7/2001 |
| JP | 2005-532968 | | 11/2005 |
| JP | 2006-168871 | | 6/2006 |
| WO | WO 2006/008586 | | 1/2006 |
| WO | WO2010079705 | * | 7/2010 |

OTHER PUBLICATIONS

Extended European Search Report dated Aug. 1, 2014 issued in European Patent Application No. 11839798.3, 5 pp.

European Examination Report dated May 11, 2015 issued in European Patent Application No. 11839798.3, 7 pp.

Chinese Office Action dated Feb. 3, 2015 issued in Chinese Patent Application No. 201180049004.3 and English translation, 19 pp.

* cited by examiner

LONGITUDINAL STABILITY MONITORING SYSTEM

This application is the U.S. national phase of International Application No. PCT/US2011/060561 filed 14 Nov. 2011 which designated the U.S. and claims priority to U.S. Provisional Patent Application No. 61/413,113 filed 12 Nov. 2010, the entire contents of each of which are hereby incorporated by reference.

BACKGROUND OF THE INVENTION

The invention relates to stability monitoring for a lift vehicle and, more particularly, to longitudinal stability monitoring for lift vehicles such as telescopic material handlers, front end loaders, and container handlers (stakers) that is determined using a rear axle load.

Lift vehicles serve to raise loads or personnel to elevated heights. For example, a telescopic material handler (telehandler) is a wheeled construction machine that carries loads to elevated heights or different locations. Such a machine tends to tip forward when overloaded or when its telescopic boom is lowered or extended at a fast rate. Stability requirements for telehandlers are controlled by the market in which they are sold. All markets share common static stability requirements that are performed on a tilt bed. Dynamic stability requirements caused by boom movement, on the other hand, vary depending on the market. In 2008, the controlling regulatory agencies in Europe introduced a new standard that requires the machine to have the intelligence and capability to stop itself in case of impending instability considering forces due to boom dynamics.

Operators of these machines prefer fast boom functions (lift up, lift down, telescope out and telescope in) so they can do more work in less time. Manufacturers tend to provide these speeds by not limiting the hydraulic system capability. Also, these boom function speeds are usually tested and documented without a load on the machine forks.

Machines generally do not have the capability to distinguish between a loaded and unloaded status, and therefore, boom function speeds stay the same whether the machine is loaded or unloaded. Experienced operators handle this situation well by adjusting the boom speed (using boom functions controlled by a joystick or the like) based on boom length and on what capacity is on the forks. Although mistakes are rare, they still happen when an operator engages the control joystick in a way that causes the boom to lift-down at a rate that makes it possible to tip the machine if a load monitoring would stop the function. It would be desirable for a longitudinal monitoring system to deal with such cases and reduce the probability of tipping.

Lowering boom function speeds was the easy solution to such a dynamic problem. Simulation results showed that the telescope-out function speed is not critical for forward tipping, and the focus should be on the lift-down function. The question then was how slow the boom lift-down speed should be to prevent tipping while operating at any point in the machine load chart. For each machine, a simulation was performed for normal lift-down with constant speed and for lift-down with sudden stops at different locations in the work envelope. Simulation results showed that to prevent tipping at any point in the load chart, current machine speeds need to be slowed down by a factor of two to three times depending on the class of the machine (max height and max capacity). Since the machine has no capability to distinguish between loaded and unloaded conditions, this simple solution was deemed unacceptable because these slow speeds would be too limiting for the machine performance particularly when it is unloaded.

SUMMARY OF THE INVENTION

The solution is a boom lift-down speed that is managed based on the machine rear axle load . The speed can be high if rear axle load is higher than a certain value, go to creep speed or zero if rear axle load is lower than another certain value, and stay as a low speed if rear axle load is between these two values. In this solution, a sensor is mounted on the machine rear axle to monitor the axle load and send a signal to the machine controller that in turn controls the boom lift-down speed by controlling the hydraulic system.

In an exemplary embodiment, a longitudinal stability monitoring system monitors longitudinal stability for a lift vehicle. The lift vehicle includes a vehicle chassis supported on front and rear wheels respectively coupled with a front axle and a rear axle, and a boom pivotally coupled to the lift vehicle. The longitudinally stability monitoring system includes a machine controller communicating with operating components of the lift vehicle, and a load sensor cooperable with the rear axle. The load sensor outputs a signal to the machine controller corresponding to a vertical load on the rear axle. The machine controller is programmed to manage boom lift down speed based on the vertical load on the rear axle.

In one embodiment, the machine controller is programmed to manage the boom lift down speed according to speed parameters including high speed, low speed and creep speed or stop. If the vertical load on the rear axle stays above a first value, the machine controller manages the boom lift down speed at the high speed parameter. If the vertical load on the rear axle becomes less than a second value, the machine controller manages the boom lift down speed at the creep speed or stop parameter. If the vertical load on the rear axle is between the first value and the second value, the machine controller manages the boom lift down speed at the low speed parameter.

The system may further include a display communicating with the machine controller that displays an operating status of the longitudinal monitoring system. The lift vehicle may include an operator input device communicating with the machine controller. In this context, the machine controller is programmed to manage the boom lift down speed based on both the vertical load on the rear axle and anticipated operator demand according to a signal from the operator input device.

In another exemplary embodiment, a method of monitoring longitudinal stability for a lift vehicle using a longitudinal stability system includes the steps of (a) monitoring a vertical load on the rear axle, and (b) managing boom lift down speed based on the vertical load. Step (b) may be practiced by managing the boom lift down speed according to speed parameters including high speed, low speed and creep speed or stop, wherein if the vertical load on the rear axle stays above a first value, the managing step comprises managing the boom lift down speed at the high speed parameter, if the vertical load on the rear axle becomes less than a second value, the managing step comprises managing the boom lift down speed at the creep speed or stop parameter, and if the vertical load on the rear axle is between the first value and the second value, the managing step comprises managing the boom lift down speed at the low speed parameter. Step (b) may be further practiced by managing the boom lift down speed based on both the vertical load on the rear axle and anticipated operator demand according to a signal from the operator input device.

In one arrangement, upon a determination of anticipated operator demand for boom lift down, step (b) may be practiced by setting the lift down speed to the low speed parameter; determining whether the rear axle load stays above the first value for a certain period of time, and if so, ramping up the lift down speed to the high speed parameter, and if not, maintaining the lift down speed at the low speed parameter; and determining whether the rear axle load becomes less than the second value, and if so, ramping down the lift down speed to the creep speed or stop parameter.

The method may additionally include a step of communicating a resulting reaction of the lift vehicle to an operator via a graphic display.

Step (b) may be practiced by managing the boom lift down speed based on a gradient of load change during operation of the lift vehicle.

The method may additionally include a step of calibrating the longitudinal stability system by recording a 0% rear axle load value and a 100% rear axle load value.

In one arrangement, if the vertical load is less than a predetermined value, the method comprises reducing the boom lift down speed. Step (b) may be practiced by managing the boom lift down speed based on both the vertical load on the rear axle and anticipated operator demand according to a signal from the operator input device, wherein if after the reducing step, the vertical load exceeds the predetermined value, the boom lift down speed is maintained until the operator input device is returned to a neutral position.

BRIEF DESCRIPTION OF THE DRAWINGS

These and other aspects and advantages of the invention will be described in detail with reference to the accompanying drawings, in which.

DETAILED DESCRIPTION OF THE DRAWINGS

Figure 1:
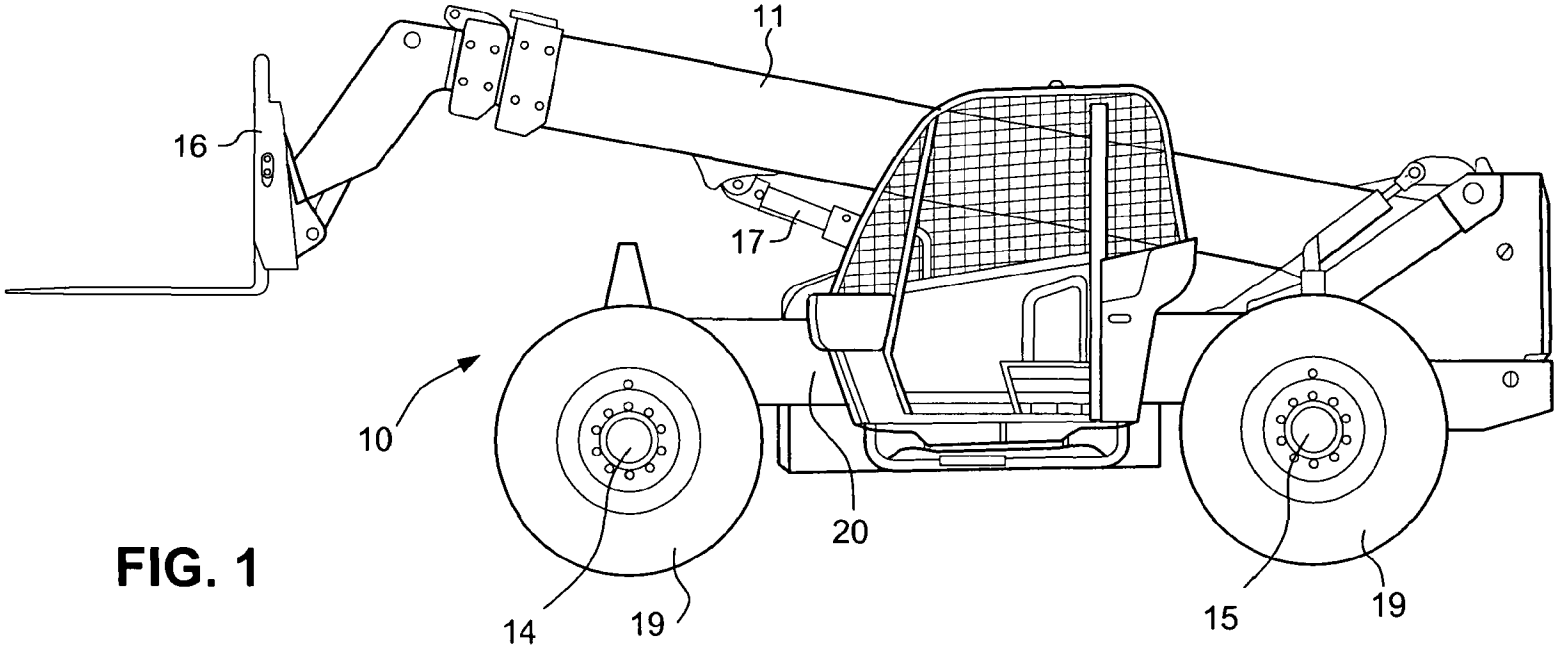
FIG. 1 shows an exemplary telehandler.

FIG. 1 shows an exemplary telescopic material handler or telehandler 10. The material handler 10 includes a vehicle frame or chassis 20 supported on front 14 and rear 15 axles, equipped with front and rear tires and wheels 19. A load handling device such as a fork carriage 16 or the like is pivotally supported at one end of an elongated telescoping boom 11. The fork carriage 16 may be replaced by a crane hook or other load handling attachment, depending on the work to be performed by the material handler 10. The boom 11 is raised and lowered via an operator input device using a boom primary cylinder 17 attached to a pivot at one end at the boom 11 and at the other end to the frame 20. Additional hydraulic cylinder structure is positioned on the boom for telescoping the boom sections in and out, also under operator control.

Figure 2:
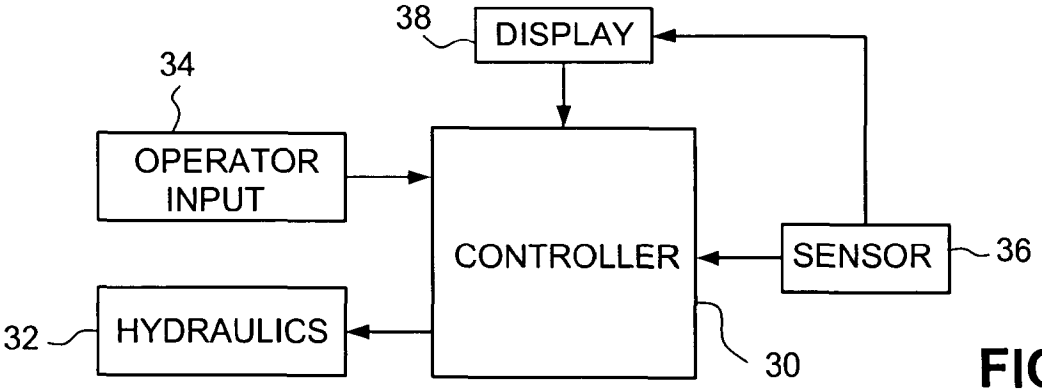
FIG. 2 is a schematic block diagram of the longitudinal stability monitoring system of the described embodiments.

Lift vehicles such as the telehandler 10 shown in FIG. 1 tend to tip forward when overloaded or when the telescopic boom 11 is lowered or extended at a fast rate. The longitudinal stability monitoring system according to the described embodiments serves to improve resistance to forward tip events by reducing machine function speeds before an unstable rear axle unloaded cutout point is reached. FIG. 2 is a schematic block diagram of the longitudinal stability monitoring system. A machine controller 30 communicates with operating components 32 of the lift vehicle. An operator input device (such as a joystick) 34 communicates with the machine controller 30 and outputs a signal representative of anticipated operator demand. A load sensor 36 is fitted to the rear axle and outputs a signal to the machine controller 30 corresponding to a vertical load on the rear axle. An exemplary sensor 36 is a redundant, thermally compensated sensor that provides strain readings on the rear axle 15 to the machine controller 30. A display 38 works in communication with the machine controller 30 and receives a signal from the sensor 36. In one embodiment, the sensor 36 provides readings to the display 38 that are then relayed to the machine controller 30. The machine controller 30 uses the information provided from the display 38 to determine an appropriate lift down speed. That is, the machine controller 30 is programmed to manage boom lift down speed based on the vertical load on the rear axle.

With the longitudinal stability monitoring system, a load or stress on the rear axle 15 is monitored, and the machine controller 30 makes decisions about machine slow down and/or cutout based on the dynamic behavior of the machine. Additionally, the load is monitored along with anticipated operator demand via monitoring a position of the operator input device 34 (such as a joystick handle) to make the boom lift down speed determination. The machine controller 30 is also programmed to consider a gradient of stress change in making the lift down speed determination. The resultant reaction of the system is communicated to the operator via the graphic display 38.

The system includes a passive stage response and a related visual indicator. A passive mode may be introduced in some models, especially smaller machines that may be used extensively for loading applications with bucket attachment (in agricultural and construction applications). The passive mode disables the function cutout as response to a low rear axle load when the machine is traveling. Cut out is disabled, but the operator is still receiving visual and audible feedback regarding the rear axle load level. This passive state is allowed based on certain positions of a F-N-R (forward-neutral-reverse) switch and the position of a park brake switch and readings from a vehicle speed sensor.

The machine controller 30 may be programmed to manage the boom lift down speed according to speed parameters including (1) high speed, (2) low speed, and (3) creep speed or stop. If the vertical load on the rear axle stays above a first value, the machine controller 30 manages the boom lift down speed at the high speed parameter. If the vertical load on the rear axle is less than the second value, the machine controller manages the boom lift down speed at the creep speed or stop parameter. Finally, if the vertical load on the rear axle is between the first value and the second value, the machine controller manages the boom lift down speed at the low speed parameter. References to "managing the boom lift down speed" at a particular speed parameter refer to maximum allowable speeds, and an operator of course is able to control operation up to the maximum allowable speed depending on the speed parameter set by the machine controller. Preferably, the machine controller manages the boom lift down speed based on both the vertical load on the rear axle 15 and the anticipated operator demand according to a signal from the operator input device 34.

Figure 3:
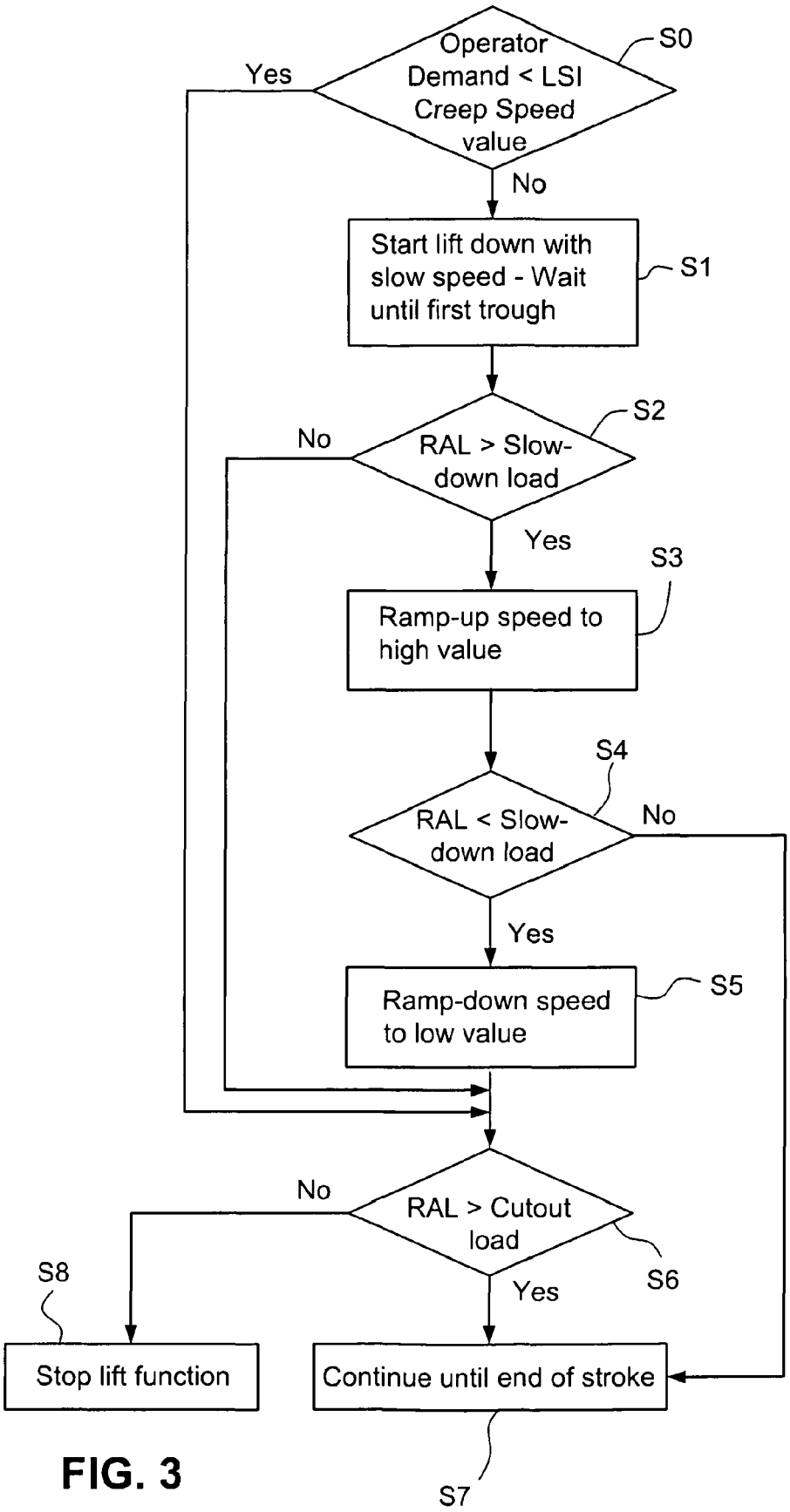
FIG. 3 is a flow diagram showing the boom speed control process.

FIG. 3 is a flow diagram showing an exemplary boom speed control process. If the operator command stays below certain value, e.g., called "LSI Creep Speed value," no lift down regulation is enforced (step 0). Operator demand larger than the "LSI Creep Speed Value" invokes the regulation process shown in FIG. 3. Rear axle load is monitored, and several boundary points have been established via modeling and testing of machine behavior. Assuming that a 100% unloaded point is a preset load point at which machine cutout is desired, a first value corresponds for example to 70% of rear axle load range, and a second value corresponds for example to 90% of rear axle load range. After some experimentation, it was determined that the boom speed profile should minimize the rear axle load response first peak, and in step S1, the lift down speed is initially set at the low speed parameter. Some aspects of machine functionality are slowed or eliminated at the low speed parameter. For example, telescope out functionality may be reduced at the low speed parameter. Other speeds may also be adjusting including tilt and auxiliary hydraulics. After starting boom lift down, the controller 30 waits a preset period of time and compares the rear axle load with the axle slow down value. An exemplary period of time is equal to three-fourths of the rear axle response first wave period. If the rear axle load is greater than the axle slow down value (YES in step S2), the lift down speed is ramped up over a predetermined period of time to the high speed parameter (step S3). If the rear axle load is less than the axle slow down value (NO in step S2), the low speed parameter is maintained, and the rear axle load is compared with the axle cutout value. If the rear axle load is greater than the axle cutout value (YES in step S6), boom lift down is continued until the end of stroke (step S7). If the rear axle load is less than the axle cutout value (NO in step S6), the lift down speed is ramped down over a predetermined period of time to the creep speed or stop parameter (step S8).

During and after ramping up to the high speed parameter in step S3, the rear axle load is continuously monitored, and if the rear axle load at any time drops below the slow down value (YES in step S4), the lift down speed is ramped down over a predetermined period of time to the low speed parameter (step S5). Otherwise (NO in step S4), boom lift down is continued at the high speed parameter.

In use, again assuming that a 100% unloaded point is a preset load point at which machine cutout is desired, if the system display reports that the rear axle has reached the 100% unloaded point, almost all hydraulic functions are inhibited including telescope out, main lift down, fork tilt up, fork tilt down, frame level left, frame level right, stabilizers up, stabilizers down, and all auxiliary hydraulics (with the exception of a hydraulic quick coupler if the machine is equipped with such an option). Only telescope in and lift up are allowed, which will enable the boom to be retracted to a safe position. The inhibited functions will not be permitted to operate unless the system override button on the cabin keypad is pressed or the machine controller determines that the rear axle has sufficient load such that a tipping event is unlikely. In a preferred embodiment, even if the machine controller determines that hydraulic function motion is safe again, the machine controller will not permit operation of the inhibited functions until the operator input device is returned to a neutral position.

Calibration of the system may occur at the factory where set up parameters will be logged with vehicle test verification sheets. Completion of the system calibration is accomplished by properly setting up the machine and recording the 0% and 100% rear axle unloaded percentage points. Once these points have been established, the machine controller can calibrate a SYSTEM CHECK POINT and verify calibration under the CALIBRATION and OPERATOR TOOLS menus, respectively.

Once system calibration is complete, the SYSTEM CHECK PT can be completed. The operator will need to remove the weight and attachment from the machine and fully telescope in and lift up the boom. Once the boom is in the proper position, the operator will be prompted to wait one minute for the moment oscillations to subside. Finally, when the operator presses the ENTER button, the machine controller will log both load cell raw sensor counts and will note the system has passed the test and under a DATALOG record, the machine hours, and the PASS condition. In the event this step was never completed or a calibration sequence of the system is detected, the control system will report and log an OUT OF CALIBRATION error.

Under an OPERATOR TOOLS menu, an operator can perform a system check. If the actual load cell raw sensor counts are within some value (e.g., +/−10 counts) of the recorded raw sensor count value recorded at time of calibration, then the machine controller will note the system has passed the test, and under the DATALOG record the machine hours and the PASS condition. If the system check has failed, the control system will report and log an OUT OF CALIBRATION error.

Various equipments may be included with the system to provide status indication. For example, a vehicle system distress indicator may be included in the cabin display and/or the platform control box. Additionally, the system may include audio alarms in the cab and at the platform. Activation of the various indicators is under control of the machine controller based on a detected status of the lift vehicle.

The longitudinal stability monitoring system provides for monitoring a load on a rear axle to provide control parameters for boom lift down speed. Additionally, the load can be monitored in combination with monitoring anticipated operator demand when making the determination. Use of the rear axle load to determine longitudinal stability results in a consistent and efficient analysis method for safer vehicle operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of monitoring longitudinal stability for a lift vehicle using a longitudinal stability system, the lift vehicle including a vehicle chassis supported on front and rear wheels respectively coupled with a front axle and a rear axle, and a boom pivotally coupled to the lift vehicle, the method comprising:

(a) monitoring, with a load sensor, a vertical load on the rear axle; and (b) managing, with a machine controller, boom lift down speed based on the vertical load, wherein upon a determination of anticipated operator demand for boom lift down, step (b) is practiced by:

the machine controller setting the lift down speed to a low speed parameter;

the load sensor and the machine controller determining whether the rear axle load stays above a first value for a certain period of time, and when so, ramping up the lift down speed to a high speed parameter, and when not, maintaining the lift down speed at the low speed parameter; and the load sensor and the machine controller determining whether the rear axle load becomes less than a second value, and when so, ramping down the lift down speed to a creep speed or stop parameter.

2. A method according to claim 1, wherein if the vertical load on the rear axle stays above the first value, the managing step comprises managing the boom lift down speed at the high speed parameter, if the vertical load on the rear axle becomes less than the second value, the managing step comprises managing the boom lift down speed at the creep speed or stop parameter, and if the vertical load on the rear axle is between the first value and the second value, the managing step comprises managing the boom lift down speed at the low speed parameter.

3. A method according to claim 2, wherein the lift vehicle comprises an operator input device, and wherein step (b) is practiced by managing the boom lift down speed based on both the vertical load on the rear axle and the anticipated operator demand according to a signal from the operator input device.

4. A method according to claim 3, wherein when the rear axle load is lower than the first value and the anticipated operator demand requests a lift down speed that exceeds the determined one of the speed parameters, step (b) is further practiced by restricting the boom lift down speed to the determined one of the speed parameters.

5. A method according to claim 1, further comprising communicating a resulting reaction of the lift vehicle to an operator via a graphic display.

6. A method according to claim 1, wherein the lift vehicle comprises an operator input device, and wherein step (b) is practiced by managing the boom lift down speed based on both the vertical load on the rear axle and the anticipated operator demand according to a signal from the operator input device.

7. A method according to claim 6, wherein step (b) is practiced by managing the boom lift down speed based on a gradient of load change during operation of the lift vehicle.

8. A method according to claim 1, wherein step (b) is practiced by managing the boom lift down speed based on a gradient of load change during operation of the lift vehicle.

9. A method according to claim 1, further comprising calibrating the longitudinal stability system by recording a 0% rear axle load value and a 100% rear axle load value.

10. A method according to claim 1, wherein if the vertical load is less than a predetermined value, the method comprising reducing the boom lift down speed.

11. A method according to claim 10, wherein the lift vehicle comprises an operator input device, wherein step (b) is practiced by managing the boom lift down speed based on both the vertical load on the rear axle and the anticipated operator demand according to a signal from the operator input device, and wherein if after the reducing step, the vertical load exceeds the predetermined value, the boom lift down speed is maintained until the operator input device is returned to a neutral position.

* * * * *